US005080123A

United States Patent [19]

Stein

[11] Patent Number: 5,080,123

[45] Date of Patent: Jan. 14, 1992

[54] SUN SHIELD ASSEMBLY

[76] Inventor: Peter Stein, 11272 NW. 14 Ct., Pembroke Pines, Fla. 33026

[21] Appl. No.: 685,192

[22] Filed: Apr. 15, 1991

[51] Int. Cl.[5] ..... E04H 15/18

[52] U.S. Cl. ..... 135/97; 135/900; 135/115; 135/114

[58] Field of Search ..... 135/87, 97, 900, 114, 135/115, 99, 105, 102

[56] References Cited

U.S. PATENT DOCUMENTS

| | | | |
|---|---|---|---|
| 1,785,953 | 12/1930 | Hanan | 135/96 X |
| 2,196,544 | 4/1940 | Bagley . | |
| 2,848,756 | 8/1958 | McCann . | |
| 3,042,053 | 7/1962 | Gabriel . | |
| 3,387,412 | 6/1968 | Kwake | 135/115 X |
| 3,397,710 | 8/1968 | McElroy | 135/97 X |
| 3,404,696 | 8/1968 | De Souza . | |
| 3,474,804 | 10/1969 | Gellert . | |
| 3,590,864 | 7/1971 | Vechesloff | 135/115 X |
| 4,540,010 | 9/1985 | May . | |
| 4,646,770 | 3/1987 | Lobato . | |
| 4,825,890 | 5/1989 | Castlebury | 135/115 X |

FOREIGN PATENT DOCUMENTS

| | | | |
|---|---|---|---|
| 739333 | 1/1933 | France | 135/114 |
| 2519529 | 7/1983 | France | 135/115 |
| 6868 | of 1906 | United Kingdom | 135/114 |
| 320280 | 10/1929 | United Kingdom | 135/115 |
| 468045 | 6/1937 | United Kingdom | 135/114 |

*Primary Examiner*—Richard E. Chilcot, Jr.
*Assistant Examiner*—Lan Mai
*Attorney, Agent, or Firm*—Malloy, Downey & Malloy

[57] ABSTRACT

A sun shield assembly composed of a canopy of pliable material which can withstand the environment of a beach, which canopy is generally rectangular in shape and which is spanned by spaced, laterally extending battens preferably received in pockets in the canopy, while the canopy is supported by at least one cross support beam, which beam includes spaced downwardly extending supporting legs; at each of the corners of the canopy, a grommet is provided from which extends a tether with a peg on the end of each to connect the tethers to the earth; the tethers are adjustable to respond to variations in wind velocity, commonly encountered at a beach.

8 Claims, 3 Drawing Sheets

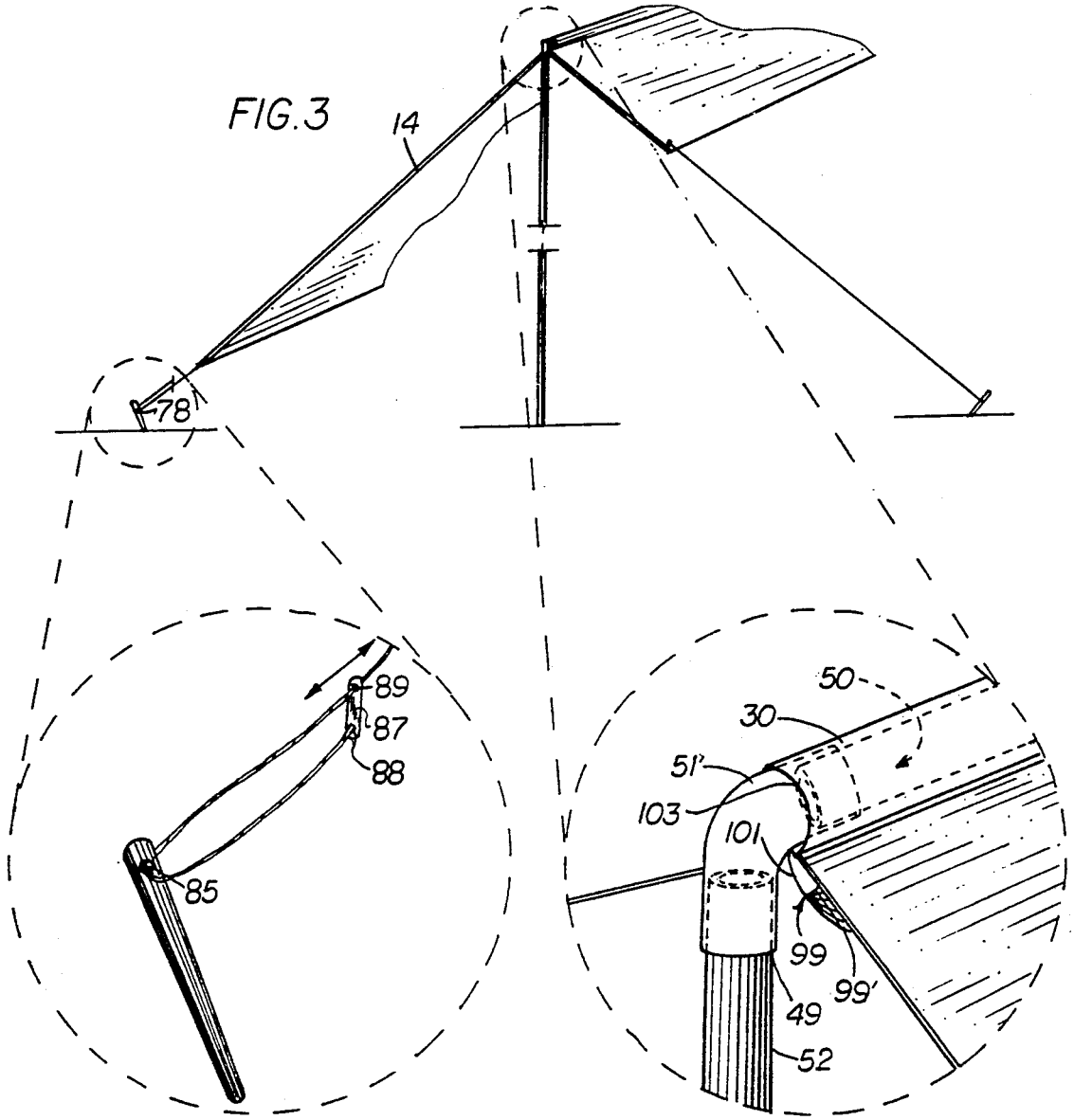
FIG.4
FIG.3A
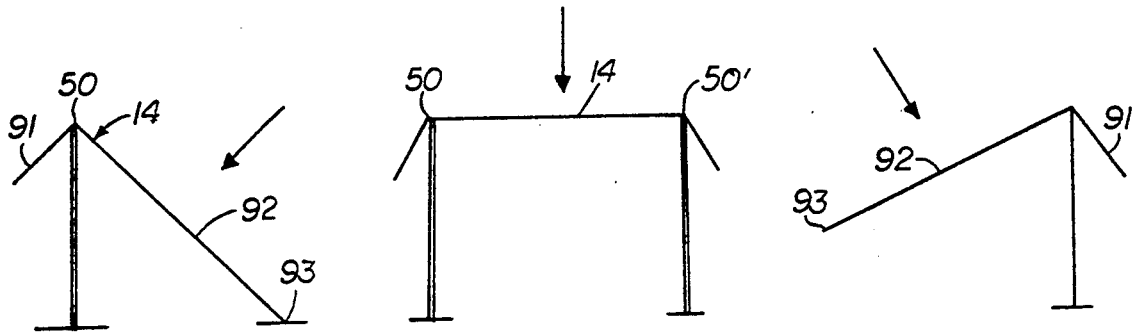
FIG.5A
FIG.5B
FIG.5C

SUN SHIELD ASSEMBLY

BACKGROUND OF THE INVENTION

1. Field of the Invention

This invention relates to a sun shield assembly and more particularly to a sun shield assembly which includes a canopy and a collapsible canopy support structure with adjustable length, tie-down tethers for the canopy, so that when the assembly is erected, it can be adjusted to accommodate differences in wind velocity as well as the direction of the sunlight, as is disclosed more fully hereinafter.

2. Summary of the Invention

There are numerous delights of the beach which include the sound of the surf, the feel of fresh wind upon the body, and other recognized enjoyments; however, there has been a growing recognition of the fact that the rays of the sun are injurious to persons, some more than others. Indeed, some persons because of fair skin, have not heretofore been able to enjoy frequent visits to the beach. This invention is of a sun shield assembly. Preferably, prior to use, it is in a knocked-down version and may be easily carried to and conveniently erected at a beach. The sun shield provides a canopy which is supported by at least one pair of leg members. The canopy is provided with adjustable length tethers so that in response to wind gusts and the like, the canopy may be "let-out" or adjusted inwardly or outwardly to in effect act like a sail and permit more or less air to pass beneath it.

In a preferred embodiment, the components of the sun shield assembly may be separated so that a relatively small "knocked-down" package may be utilized. In a preferred embodiment, the sun shield assembly provides a shaded zone which is about 80" in height and about 5' wide, while the overall length of the canopy is about 9½'. The shaded area beneath the canopy varies somewhat because of the fact that the slope of the canopy is adjustable and hence responsive to changes in wind velocity to the changing angles of the sun throughout the course of a day. Further, in a preferred embodiment, see FIG. 3A, there may be provided an article holding device 99 which may be in the form of an article holding swing or "mini hammock," which is supported on a pair of lines, such as line 101 beneath the loop 103 about the cross support beam 50, and which is useful for holding bottles of sun cream lotions and the like. It will be appreciated that the canopy may be provided with advertising indicia; and, indeed, the sun shield assembly may be personalized in that the name or the nickname of the occupants, for example, may be provided on a generally front portion or on the rear portion of the erected sun shield assembly.

BRIEF DESCRIPTION OF THE DRAWINGS

In accordance with the foregoing, the invention will be described on reference to the accompanying drawings, in which:

FIG. 3 is a partial perspective view of the assembly;

FIG. 3A is a partial perspective view of the indicated portion of FIG. 3;

FIG. 4 is a partial perspective view of the indicated portion of FIG. 3, which is circled;

FIG. 5A, 5B, and 5C are schematic views illustrating the sun shield assembly in a variety of erected attitudes.

DESCRIPTION OF THE PREFERRED EMBODIMENT

Figure 1:
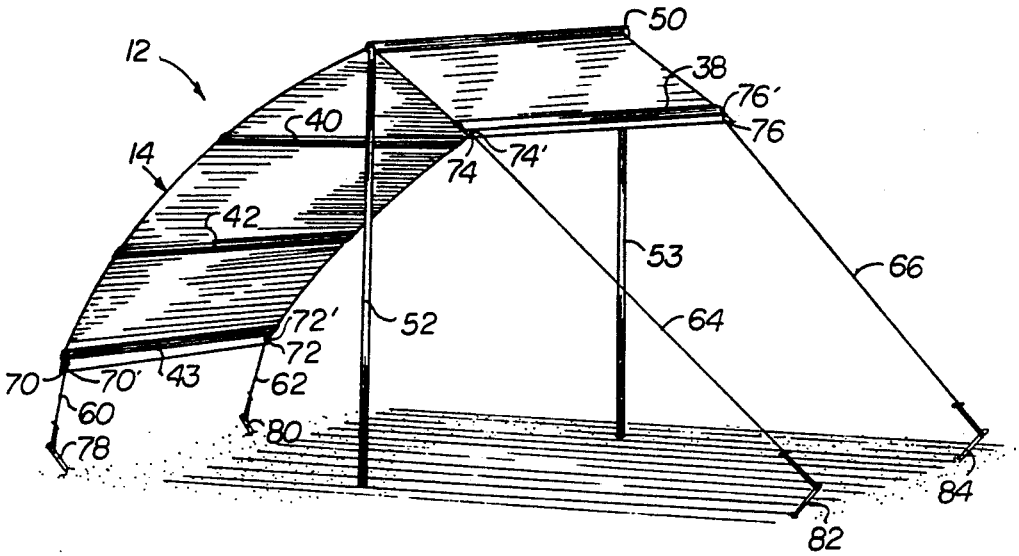
FIG. 1 is a perspective view of the erected sun shield assembly.

Referring to the drawings and particularly to FIG. 1, there is shown a sun shield assembly 12 which is composed of a canopy 14 of rectangular pliable material. Battens span the canopy 14, which are designated by the numerals 38, 40, 42 and 43. At least one cross support beam 50 is provided, which also may be considered to be a batten. The batten pocket at 42 can also be used as a pocket to receive either a first or second cross member support beam such as that shown at 50. The support beam is provided with vertical supports 52 and 53. Four tethers 60, 62, 64 and 66 connect the corners 70, 72, 74 and 76 of the canopy with pegs 78, 80, 82 and 84 which are secured at spaced locations in the earth as shown.

Figure 2:
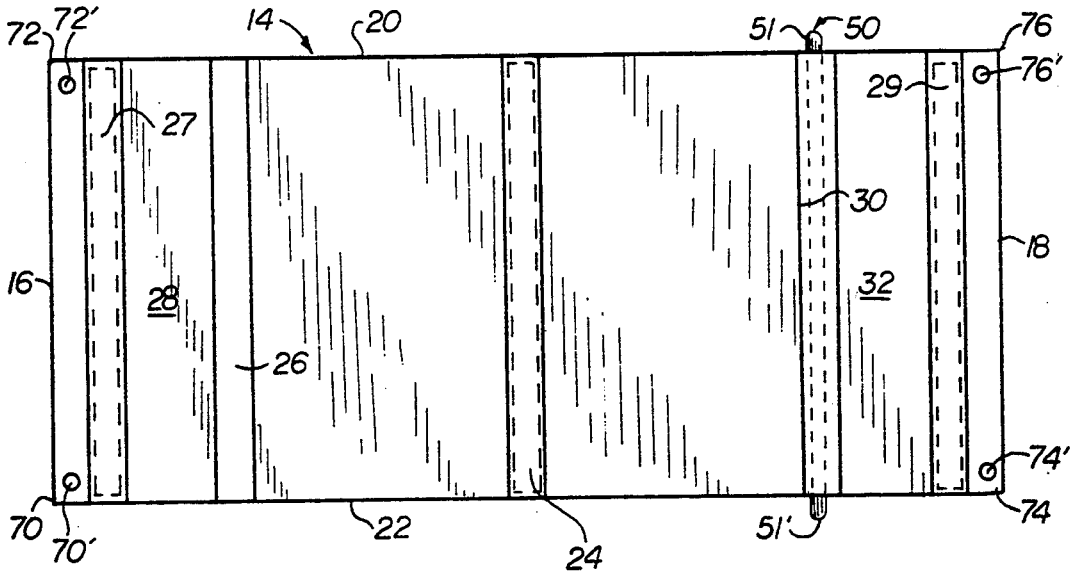
FIG. 2 is a plan view of the canopy of the assembly which includes at least one cross member support beam, as shown with a pair of supporting legs.

Referring now to FIG. 2 and to the canopy in more detail, it is seen that it has a first and a second opposed end 16 and 18, each of which are of a length between 4' and 6' but preferably 5'. The canopy further defines two longitudinally extending side edges 20 and 22, each of a common length between 8' and 11', but preferably being 9½. It is seen that the canopy is provided with pockets extending between the longitudinally extending side edges, a) a central batten pocket 24, b) a first batten pocket 27, adjacent the first end and a second batten pocket 29 adjacent the second end. Each of these batten pockets extend across the canopy between the side edges and, in a preferred embodiment, the first and second batten pockets 27 and 29 are spaced inwardly, so as to be adjacent the first and second ends respectively, while a flap 28 and 32 between the batten pockets adjacent each end of the canopy is formed. Preferably batten pockets 27 and 29 are provided, one at each end of the canopy.

There are support legs and a cross beam provided for supporting the canopy in an erected position, as will now be described. It is seen from FIGS. 3 and 3A that at least one of the batten pockets, such as 26 or 30, receives the cross support beam 50. This beam, which can also be considered a batten, extends completely between the side edges and extends outwardly from those canopy side edges, being provided with a downwardly opening mouth at each end. In the preferred embodiment, the cross support beam 50 is received in one of the pockets, such as 30 and is of a length to span the canopy between the longitudinal side edges and includes a portion 51 and 51', see FIG. 2 and FIG. 3A, extending downwardly from the beam to receive extending support legs, 52 and 53, seen in FIG. 1. Means are provided for connecting these vertical legs, which may be of any suitable type. For example, the extending portions may each be downturned and have a receiving socket 49, see FIG. 3A, to receive the upper end of one of the support members, such as 52. The upper end zone of each of the support members may be of somewhat reduced diameter defining an abutment shoulder so that the reduced diameter portion is received within the end portions with the terminal end of the downturned cross member support beams being in abutting engagement with the shoulder thus formed. In the preferred embodiment, the vertical support members are of an overall length between 6' and 8'; however, they are preferred to be at least 5' in length and preferably 78" to 80" in longitudinal length. These vertical support members may, if desired, be composed of two interconnected lengths so that in a "knocked-down" version, less space is required for storing the assembly. Finally, with respect to the assembly, it is seen in FIG. 1 that adjustable length tether means 60, 62, 64 and 66 are provided for each of the canopy corners 70, 72, 74 and 76, the proximal end of the tether means being preferably tied to a grommet such as 70', 72', 74' and 76' one of which is provided in each of the canopy corners. To the distal end zone of each of the tethers, a peg means is provided, 78, 80, 82, and 84, each of which peg means may be provided with a hole 85, see FIG. 4, to accommodate looping of the distal end zone of the tether to it and, preferably, the adjustable tether means includes a device, such as 87, see FIG. 4, with a top opening 89 through which the distal end zone of the associated tether is threaded with the distal end also being threaded through the hole 85 of the peg 78 and the terminal end being secured to the device 87 through the bottom opening of the device 88. Thus, the length of the tether is adjustable to alter the main slope of the canopy responsive to variations in wind velocity and the angles of the sun at the beach.

Referring now to FIG. 5A, it is seen that the canopy 14 may be erected with the front portion 91 being somewhat shortened and with the rear portion 92 extending outwardly to a terminal end 93, the height of which above the ground may be adjusted and controlled by adjustment of the tether means seen in FIG. 4, simply by threading the member longitudinally along the tether thereby lengthening or shortening the double tether length at the distal end zone. In this manner, the resistance offered to wind or gusts of wind may be accommodated. FIG. 5C shows the configuration of the assembly and particularly the canopy when the tethers 60 and 62 are adjustably lengthened. In a further preferred embodiment, see FIG. 5B, it is seen that the canopy may be provided with two cross support beams 50 and 50' and in effect a cabin-like structure is defined.

In use, one planning to utilize the assembly at a beach, would carry it, for example, in the trunk of a car. At the beach, the canopy would be unrolled, the battens inserted together with at least one cross support beam, and the vertical support members would be assembled and connected to the cross support beam. Thereafter, a tether would be provided for each of the corner grommets and secured to the earth using the pegs. Then, the length of each of the tether means 60, 62, 64 and 66 would be adjusted using the adjustment means seen in FIG. 4 to meet the wind conditions and angle of the sun at the beach at the time of erection and subsequently as conditions change, the tethers could be adjusted. Referring to the configuration shown in FIG. 5A, if the sun is coming from the left, as in the case of a morning sun, there will be some shade provided within the canopy by reason of the forwardly extending portion 91. On the west coast, for example on the west coast of Florida or in California, the sun shield portion 91 would face the sun and during the morning hours, the longitudinally extending portion 92 would provide shade.

Figure 6:
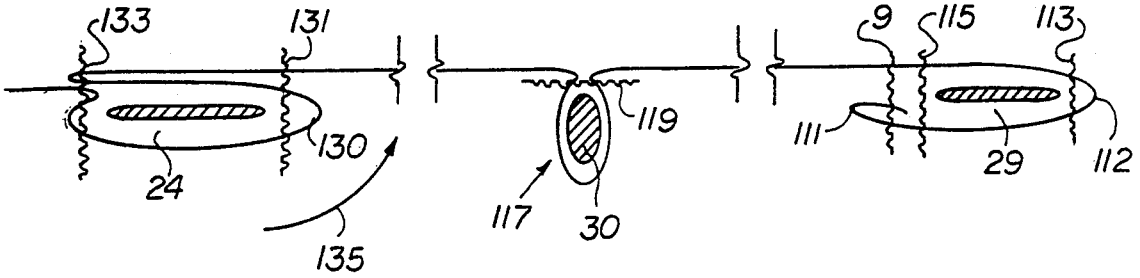
FIG. 6 is a partial schematic view of the formation of the pockets, as will be described more fully hereinafter.

Referring briefly to FIG. 6, there is shown, schematically, a suitable arrangement for forming the batten pockets. For example, in the case of the batten pocket 29, the terminal end of the canopy 14 may be folded back upon itself as at 111 and stitched to the canopy as at 9. Also at 112, the canopy is folded as shown and then stitched along a stitch line 113 spaced from a stitch line 115 thus forming the batten pocket 29. The terminal edge as at 111 is preferably stitched to the canopy. The batten pockets between the ends may simply be folded out of the main plane of the canopy as at 117 and stitched across as indicated by the stitch line 119 to form the batten pocket 30. Alternatively, as in the case of the batten pocket 24, the canopy may be formed in the same way; however, the apex of the folded out portion as at 130 may be stitched by the seam 131 to the canopy with an additional seam 133 being provided after it has been folded in the direction of the arrowed line 135 so that the structure forming the pocket 24 is connected to the canopy across the entire width of it.

There has thus been provided a device which will provide a shady spot at a beach, for example, it may also be used while camping or any other place protection from the sun is desired. The construction of the assembly permits it to be erected in less than five minutes. The canopy portion is made from fabric which can withstand the harsh environment of the beach and which is preferably, highly resistant to sun, salt water, salt air, rain, abrasive sand, and suntan oils, etc. It is preferably highly resistant to tearing, cutting, and ripping. The fabric is also suitable for long lasting, silk screened advertising indicia or personalizing; further, other types of well-known methods such as printing may be used to apply indicia.

Preferably, the support legs are made from $\frac{3}{8}$" to $\frac{7}{8}$" aluminum tubing and breaks down into portions. For example, one of the legs may break into two portions. Also, the support beam may be separated into several interconnectable portions. The wall thickness and the alloy used for the cross beam and the support legs is such as to not deflect across the preferred 5' length of the support beam between the legs. In a preferred embodiment, the support legs and the support may be coated with a protective material. Finally, in the preferred embodiment, the battens provided in the presewn batten pockets are made from material which is flexible but also stiff enough to maintain the basic rectangular shape of the canopy. The battens withstand the pressures of wind in the 15 mph–35 mph range. The battens preferably break down into three 2 section groups. Thus, there has been provided an assembly which provides a sun shield as opposed to a tent or a hut, and which is adjustable, much as a sail is adjustable, so as to be responsive to changes in wind velocities or angles of the sun encountered at a beach, and permitting more or less air to flow beneath the canopy. In use, the canopy flexes and bends being responsive to the wind; and the assembly will remain erect, in the face of increases or decreases in wind velocity, since it is adjustable. The pressure responsive to the wind forces is adjustable by the tension adjusters which have been provided which slide along the tethers at their terminal ends, with the tethers anchored to the earth through the pegs or stakes. Preferably, the canopy is provided with integral batten pockets sewn into it, and in the preferred embodiment, three flexible battens are provided which are sized to be received in three respective batten pockets. Each of the battens, in a preferred construction, may break down into two sections for ease of storage, which is also true of the support legs and the support beams. In use, the basic rectangular shape of the major sun shade portion of the canopy is maintained, while the battens are somewhat yieldable so as to allow the canopy to distort in a controlled manner in response to wind variations. It will be appreciated that the battens prevent the canopy from flapping during shifting wind conditions. Finally, in a preferred embodiment, the canopy has two cross member pockets and accommodate two cross member support beams, if the configuration shown in FIG. 5B is desired, however, the configuration in FIG. 5A, similar to 5C is the preferred configuration for use. An important feature of the invention is the provision of the article holding mini-hammock, see FIG. 3A, the mini-hammock being designated by the numeral 99. This can accommodate storing different items used at the beach. Another important aspect of this invention is that the entire assembly can be knocked down and stored conveniently in a relatively small space, for example, in the trunk of a car. When erected, the structure provides a shaded height beneath it in which one can stand or sit in a beach chair. Finally, it will be apparent on comparison of FIGS. 5A and 5C that the structure can be altered to accommodate the changing angle of the sun.

While this invention has been shown and described in what is considered to be practical and preferred embodiments, it is recognized that departures may be made within the spirit and scope of this invention which should, therefore, not be limited except as set forth in the claims hereinafter and within the doctrine of equivalents.

What is claimed is:

1. A sun shield assembly comprising:

A) a canopy of generally rectangular pliable material having, a) a first and a second end, and each end being of a length of between 4' and 6', and including a central zone between the ends, b) two longitudinally extending side edges, each of a length of between 8' and 11', c) said canopy including a batten pocket in the central zone and extending between the side edges, and d) a first batten pocket adjacent the first end and extending between the side edges, e) a second batten pocket adjacent to the second end and extending between the side edges, f) a first cross support beam pocket extending between the side edges and located between the central batten pocket and said first batten pocket and adjacent said first batten pocket, B) a batten in each of said batten pockets and each batten being of a generally common overall length and sized to substantially span the canopy between the side edges, C) a cross support beam in said first cross support beam pocket, a) said beam being of a length to span the canopy between the longitudinal side edges and including a portion extending outwardly of said canopy at each canopy side edge, b) said cross support beam member further including a pair of downwardly extending support members for said canopy, c) each support member being of a common length of at least 5', d) each of said support members having an upper end and a lower end, e) said cross member support beam further including means to connect the upper end of each support member to one of said outwardly extending portions, and D) adjustable length tether means including four separate tethers, each tethers having a proximal end and a distal end, and the proximal end of each of said tethers being connected to the canopy adjacent one of the junctures of said side edges, E) said tether means including peg means adjacent the distal end of each tether.

2. The sun shield assembly as set forth in claim 1 wherein the lower end of each of said support members is configured to be inserted into a support surface.

3. The sun shield assembly as set forth in claim 1 wherein the first batten pocket is spaced from said first end defining a first outer end flap between the first pocket and the first end; and said second batten pocket is spaced from said second end defining a second outer end flap between the second batten pocket and the second end.

4. The sun shield assembly as set forth in claim 1 wherein said canopy is provided with a second cross support beam pocket extending between the edges and said second beam pocket is located between the second batten pocket and the central batten pocket and adjacent said second batten pocket, and said assembly includes a second cross support beam in said second cross beam support pocket including a pair of downwardly extending support members.

5. The sun shield assembly as set forth in claim 1 wherein the support members each comprise mating interconnected elongate portions.

6. The sun shield assembly as set forth in claim 1 wherein the adjustable length tether means includes a member with a hole therethrough threaded onto each of the tethers adjacent the distal end of each and said member is secured to the distal end of each tether mean, whereby the length of tether is adjustable by advancing or withdrawing the tether threadably through the hole.

7. The sun shield assembly as set forth in claim 1 wherein the canopy side edges are of a common length of about 9½' and the side edges are spaced from another distance of about 5'.

8. A sun shield assembly for a Wind exposed support surface to avoid sun rays comprising, an elongate canopy of pliable material having a longitudinal centerline, spaced longitudinally extending side edges and opposed end edges spanning the side edges and defining four canopy corners, grommet means at each of said corners, spaced batten means on the canopy and extending between the side edges to resist bowing of the canopy with respect to the longitudinal centerline, said batten means including a support beam spaced from and adjacent one of said end edges defining, a) on one side of said beam, a sun shield panel means, said shield panel means extending downwardly and outwardly from the support beam to block the sun rays adjacent the support beam, and, b) on the other side of said beam, an elongate wind responsive canopy portion, a pair of spaced support leg means to support and maintain said beam in a generally horizontal attitude at a height of at least five feet about the horizontal surface, tether means extending from the grommet means of said shield panel means, said tether means including peg means to connect the tether means to the support surface, and to maintain the shield portion in a generally inclined plane extending downwardly and outwardly from the support beam, adjustable tether means extending from the grommet means of the elongate wind responsive canopy portion including, peg means to connect the adjustable tether means to the support surface, said adjustable tether means being effective to adjust the slope of the elongate canopy portion between the grommets of the elongate portion and the support beam in response to wind forces, and the changing angles of the sun.

* * * * *